United States Patent [19]

Croese

[11] 3,938,676

[45] Feb. 17, 1976

[54] FLOATING UNLOADING INSTALLATION FOR LIGHTERS

[76] Inventor: Hendrik Magchiel Willem Croese, Schiedamseweg 103, Vlaardingen, Netherlands

[22] Filed: Sept. 30, 1974

[21] Appl. No.: 510,715

[30] Foreign Application Priority Data

Apr. 26, 1974 Netherlands ..... 7405664

[52] U.S. Cl. ..... 214/13; 214/14

[51] Int. Cl.[2] ..... B65G 67/58

[58] Field of Search ..... 214/13, 14; 198/39

[56] References Cited

UNITED STATES PATENTS

| | | | |
|---|---|---|---|
| 48,495 | 6/1865 | Taggart | 214/13 |
| 1,584,496 | 5/1926 | Verhoeff | 198/39 X |
| 3,469,715 | 9/1969 | Bocchietti | 214/14 |
| 3,515,086 | 6/1970 | Auzins | 214/15 R X |

FOREIGN PATENTS OR APPLICATIONS

| | | | |
|---|---|---|---|
| 1,217,826 | 12/1970 | United Kingdom | 214/13 |

*Primary Examiner*—Robert J. Spar
*Assistant Examiner*—George F. Abraham
*Attorney, Agent, or Firm*—Diller, Brown, Ramik & Wight

[57] ABSTRACT

This disclosure relates to a floating unloading installation for unloading lighters and includes two pontoons which are secured together in fixed transverse spaced relation with the spacing between the pontoons being sufficient to accommodate between the pontoons a conventional lighter for movement therebetween, the pontoons being connected together by connecting means which includes a tranverse bridge and the bridge having mounted thereon in balanced relation for swinging movement generally across the space between the pontoons to assure the complete unloading of a lighter disposed between the pontoons, the digging means including first conveying means for delivering material to the bridge, the bridge having second conveying means for delivering material to one of the pontoons, the one pontoon carrying a vertical conveyor which is mounted in a tower forming a part of the bridge, and there being carried by the tower for swinging movement a distributing conveyor adapted to receive material from the vertical conveyor and for distributing material into a hold of a ship.

8 Claims, 1 Drawing Figure

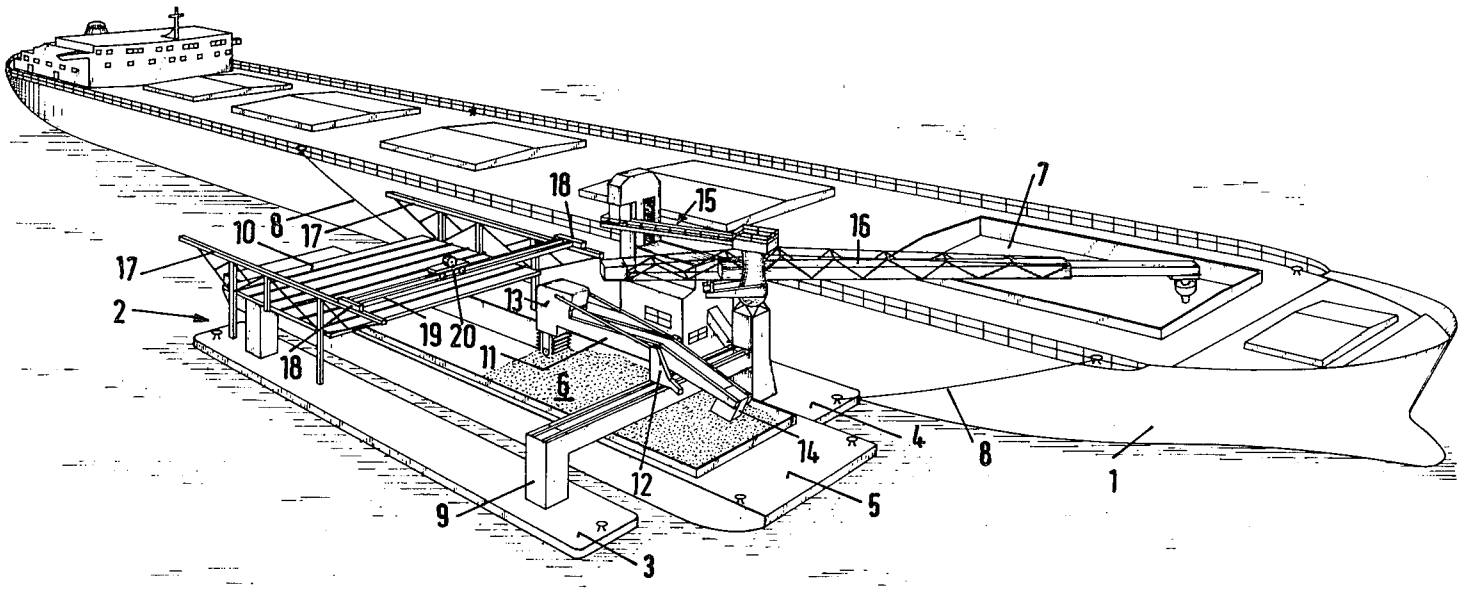
1
7
8
4
5
16
14
15
12
3
18
6
13
11
20
19
9
17
10
8
18
17
2

FLOATING UNLOADING INSTALLATION FOR LIGHTERS

This invention relates to a floating unloading installation for lighters, comprising a digging means mounted on a craft which can be brought alongside a seagoing ship, the digging means being capable of removing bulk cargo from a lighter. A weighing means may be provided on the craft as well as a vertical conveyor for raising the bulk cargo so that it can reach the hold of the seagoing ship through a sloping conveying means.

As a result of the depth of the water being insufficient it is often not possible to load larger seagoing ships directly at a quay where, for instance, a grain elevator is located. Therefore floating unloaders of the type described in the opening paragraph are used with which such seagoing ships can be handled in midstream.

In the known floating unloaders the craft is often a barge or pontoon. The digging means is a swivelling grabbing crane, which removes an amount of bulk cargo from the lighter, feeds it to the hopper of a weighing installation, that is, if such a weighing installation is used, after which the weighed material is raised through a vertical conveyor so that the material is dumped into the hold of the seagoing ship by means of an inclined conveying means, for instance a chute.

These known floating unloading installations have the following drawbacks.

In a swivelling crane with a grab the centre of gravity is displaced during swivelling and emptying the grab in such a way that the pontoon is swinging virtually constantly, which results in the top of the vertical conveyor with the chute swinging to and fro to an intolerable extent. Consequently it is neither quite possible to fill a hold through the narrow openings in the deck, as present in ships of the so-called L.A.S.H. type ("lighter aboard ship"). The central hold of ships of this type is used for the overseas transport of filled lighters, in the same way as containers. The spaces between the central hold and the hull of the ship are used as tanks, so-called wing tanks or side tanks. These side tanks are accessible through filling openings located along the sides of the deck of the ship. It will be clear that it is difficult to dump, for instance, grain accurately in these openings from a swinging pontoon.

Another drawback of the known installation is that a swivelling crane with a grab, which has to empty itself in, for instance, the hopper of a weighing means, makes dust swirl up and thus causes unallowable environmental pollution.

Still another drawback of the known installation is that the lighter to be unloaded, which may have a length of, for instance 60 metres, is located at the outerside of the pontoon — that is to say, the pontoon lies between the lighter and the seagoing ship — and is much exposed to currents in the river. Therefore the lighter often has to be continuously controlled by a tug during unloading.

This invention aims at removing the above-mentioned drawbacks of an installation of the type described in the opening paragraph.

In accordance with the invention the craft is designed as an assembly of two pontoons with a space therebetween so that a lighter can be hauled longitudinally between the two pontoons, while a continuously operating digging elevator with a radius covering the width of the hold of the lighter is mounted in balance on a bridge or portal connecting the two pontoons, and in the cross-linkage there are conveying means for conveying the material scooped up by the elevator to one of the pontoons on which the vertical conveyor, and if desired a weighing means, and the sloping conveying means are provided.

As instead of a swivelling grabbing crane a continuously operating digging elevator is used, which is located at one end of an arm supported on the bridge or the portal and pivotable about the centre, at the other end of which a counterweight is located, the displacement of the centre of gravity during operation is negligible. Dust only swirls up a little at the lower receiving end of the digging elevator which, for that matter, can be of a known construction i.e. completely closed and dust tight.

As the lighter lies between the two pontoons, which, for instance, may each have a length of 42 metres, the lighter is well protected against river currents. Therefore it is not necessary to use tugs to control the lighter and the lighter can be anchored to one of the pontoons by means of hauling winches.

An additional advantage of the stability of the double pontoon is that, when a weighing means is used, it operates reliably.

In a further elaboration of the invention the sloping conveying means can be constructed as a telescopic belt conveyor. The top of the vertical conveyor has to be at such a height that if the usual sloping chute is used for conveying the bulk material from the lighter into the hold of a ship it extends sufficiently far to fill an empty and therefore a light-draught seagoing ship. This entails that as soon as the ship comes to lie deeper in the water or as soon as it is not necessary for the conveyor to extend that far, the height for dumping the materials is useless and results in a high rate of fall so that again dust is formed causing unallowable environmental pollution. By using, in accordance with the invention, instead of a sloping chute a telescopic belt conveyor which, for that matter, may be of a known type, and with which therefore various ranges can be controlled without falling movements of the material occurring and the slope of which belt conveyor moreover can be varied and thus the heights of various seagoing ships can be controlled, it is possible to control the conveyance of the material as near as possible to its place of destination and without excessive formation of dust. The belt conveyor may be pivotable with respect to the seaship so that less hauling has to be done.

The hold of a lighter is often covered by a plurality of hatch covers, usually between 8 and 13. Before unloading they have to be taken from the lighter and temporarily stored, for which purpose a grabbing crane is used in the known transfer installation.

According to the invention a hatch cover platform extends transversely between the pontoons at one end thereof, while furthermore a hatch cover crane adapted to lift hatch covers one by one and place it on the hatch cover platform, can be moved along the hatch cover platform.

An important advantage of the floating unloading installation according to the invention, comprising two pontoons and, in between them, accommodation for a lighter and a vertical conveyor on one of the pontoons and a sloping conveyor for dumping bulk cargo in a seaship, is that with a minimum number of hauling movements the entire hold of the seagoing ship can be attended to. It is true that according to the invention the sloping conveying means has a variable effective length, but it makes an essential difference whether a normal freighter for bulk cargo, a so-called bulk carrier has to be loaded or a so-called L.A.S.H. ship. For in normal freighters the central portion where the hold is located has to be covered with the sloping conveying means, whereas in L.A.S.H. ships the openings at the side of the ship's deck have to be attended to. In the installation according to the invention the pontoon assembly can be placed alongside the L.A.S.H. ship in a position so that the vertical conveyor tower is located on the pontoon remote from the seagoing ship. It is clear that, in particular in view of the combination with the variable effective length of the sloping conveying means, a great number of side tank filling openings can be attended to without hauling the unloading installation relative to the ship.

An embodiment of the floating unloading installation will now be described and elucidated with reference to the accompanying drawing.

The drawing shows in perspective a freighter 1 and alongside of the freighter a floating unloading installation 2, composed of two pontoons 3 and 4. Between pontoons 3 and 4 there is shown a lighter 5, the bulk cargo 6 of which has to be transferred, to a hold 7 of the freighter 1. The floating unloading installation 2 is fixed with respect to the anchored freighter 1 with the aid of cables 8.

The two pontoons 3 and 4 of the discharge installation 2 are interconnected, on the one hand by a bridge or portal and, on the other hand, through a hatch cover platform construction 10. On portal 9 there is located a tubular arm 11, which is supported near the middle thereof on portal 9 in supports 12, which are horizontally swivable about the vertical axis. At one end of the tubular arm 11 there is located a digging unit illustrated as an elevator 13, for instance a bucket conveyor, and at the other end a counterweight 14 is provided so that elevator 13 is substantially in balance and when elevator 13 makes vertical swivelling movements virtually no displacements of the centre of gravity with respect to the pontoon assembly 3 and 4 occur. In the tubular arm 11 there is located a conveyor (not shown), which conveys the material raised by elevator 13 in the direction of the horizontal portion of portal 9. Between supports 12 the material of the conveyor in tube 11 is transferred to the conveyor located in the horizontal portion of portal 9, which conveys the material to the right-hand side in the drawing, to an installation having the general reference numeral 15 in the drawing. In this installation a known per se weighing means may be present as well as a vertical conveyor conveying the material to such a level that it can reach hold 7 of the ship 1 through a sloping conveyor 16. The weighing means and the details of the construction of the vertical conveyor and any other apparatus in the installation 15 will not be further described, because such apparatus are known per se in transfer means of the present type.

According to the invention the sloping conveyor 16 consists of a telescopic belt conveyor, that is to say, a belt conveyor in which the distance between the point where the material is dumped and the terminal roll can be changed by sliding the entire conveyor to and fro under the point where the material is dumped.

The conveyor can also be formed by a succession of conveyor belts that can be displaced with respect to one another, or a conveyor belt in which the distance between the initial roll and the terminal roll can be changed, as known per se. As it is possible to change the effective horizontal conveying distance in conveyor 16, optimum adaptation to the height of freighter 1 is possible and the material can be conveyed as near as possible to its place of destination so that free fall of the material and dust formation are minimized.

Hatch cover platform 10, like portal 9, extends between the two pontoons 3 and 4. At each end of the deck there is located a guideway 17 for a carriage 18. Carriages 18 carry a guideway assembly 19 for a hatch cover crane 20. With the hatch cover crane 20 the hatch covers of lighter 5 can be lifted and stored on platform 10 during unloading of the lighter.

I claim:

1. A floating unloading installation for unloading lighters, said installation comprising two pontoons, connecting means fixedly securing said pontoons together in transversely spaced relation with the spacing between said pontoons being sufficient to accommodate between said pontoons a conventional lighter for movement therebetween, said connecting means including a transverse bridge fixedly mounted on said pontoons, digging means, means mounting said digging means on said bridge in a balanced state and for movement both generally across the space between said pontoons and about a vertical axis to assure the complete unloading of a lighter disposed between said pontoons, said digging means including a digging unit and first conveying means for delivering material from said digging unit to said bridge, said bridge having vertically fixed second conveying means for delivering material to one of said pontoons, and third conveying means for delivering material from said one pontoon away from said installation.

2. The floating unloading installation of claim 1 wherein said third conveying means includes a vertical conveyor carried by said one pontoon for receiving material from said second conveying means and a distributing conveyor for receiving material from said vertical conveyor and discharging the same outwardly of said installation.

3. The floating unloading installation of claim 2 wherein said vertical conveyor includes a tower forming part of said bridge.

4. The floating unloading installation of claim 2 wherein said vertical conveyor includes a tower forming part of said bridge, and means pivotally mounting said distributing conveyor on said tower.

5. The floating unloading installation of claim 2 wherein said distributing conveyor is a sloping belt conveyor having a variable effective horizontal length of conveyance.

6. The floating unloading installation of claim 5 wherein adjacent ends of said pontoons remote from said bridge there is a hatch cover platform extending between said pontoons and forming part of said connecting means, guideways at ends of said hatch cover platform extending longitudinally of said plontoons, and carriages carried by said guideways supporting a transverse guideway assembly for a hatch cover crane.

7. The floating unloading installation of claim 1 wherein adjacent ends of said pontoons remote from said bridge there is a hatch cover platform extending between said pontoons and forming part of said connecting means, guideways at ends of said hatch cover platform extending longitudinally of said pontoons, and carriages carried by said guideways supporting a transverse guideway assembly for a hatch cover crane.

8. The floating unloading installation of claim 1 together with weighing means disposed between said second conveying means and said third conveying means.

* * * * *